US010471310B2

(12) United States Patent
Brady

(10) Patent No.: US 10,471,310 B2
(45) **Date of Patent: *Nov. 12, 2019**

(54) GOLF CLUB SYSTEM WITH INTERCHANGEABLE GOLF CLUB HEADS

(71) Applicant: Patrick K. Brady, Glen Ellyn, IL (US)

(72) Inventor: Patrick K. Brady, Glen Ellyn, IL (US)

(73) Assignee: Sepia Products, LLC, Glen Ellyn, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/396,269

(22) Filed: Dec. 30, 2016

(65) Prior Publication Data

US 2017/0209749 A1 Jul. 27, 2017

Related U.S. Application Data

(63) Continuation of application No. 14/814,438, filed on Jul. 30, 2015, now Pat. No. 9,533,199, which is a continuation-in-part of application No. 14/142,739, filed on Dec. 27, 2013, now abandoned.

(60) Provisional application No. 62/031,145, filed on Jul. 30, 2014, provisional application No. 61/747,180, filed on Dec. 28, 2012.

(51) Int. Cl.
*A63B 53/02* (2015.01)
*A63B 53/00* (2015.01)

(52) U.S. Cl.
CPC ..... *A63B 53/02* (2013.01); *A63B 2053/005* (2013.01); *A63B 2210/50* (2013.01)

(58) Field of Classification Search
CPC ..... A63B 53/02; A63B 2210/50; A63B 2053/005
See application file for complete search history.

(56) References Cited

U.S. PATENT DOCUMENTS

| | | | | |
|---|---|---|---|---|
| 2,464,850 A * | 3/1949 | Crawshaw | A63B 53/00 473/299 |
| 4,340,227 A * | 7/1982 | Dopkowski | A63B 53/02 206/315.2 |
| 5,451,031 A * | 9/1995 | Purvis | F16L 37/46 251/100 |
| 6,547,673 B2 * | 4/2003 | Roark | A63B 53/02 473/239 |
| 6,890,269 B2 * | 5/2005 | Burrows | A63B 53/02 473/307 |

(Continued)

*Primary Examiner* — Stephen L Blau
(74) *Attorney, Agent, or Firm* — David C. Isaacson; Fitzgerald & Isaacson, LLP

(57) ABSTRACT

A system of interchangeable club heads sharing one or more shafts and golf bag for carrying the club heads and one or more shafts. The club heads contain a shaft segment to set club length and a coupler to interconnect to the shaft and grip. The shaft contains an opposite gender coupler. The system is very lightweight and much more portable than a conventional set of golf clubs. It also creates the opportunity for players to match club heads with shafts with differing performance characteristics. Additionally, it solves a problem for golfers using long shafts on putters. These long shafts can now be disassembled for storage and transport. A ramp on the circumference of one end of a pullback sleeve works in conjunction with a post on a grip end fitting to more tightly couple the club head end to a shaft.

10 Claims, 9 Drawing Sheets

(56) References Cited

U.S. PATENT DOCUMENTS

| | | | | |
|---|---|---|---|---|
| 7,775,902 | B2 * | 8/2010 | Churovich | A63B 53/00 403/297 |
| 9,808,679 | B1 * | 11/2017 | Seluga | A63B 53/02 |
| 2012/0227257 | A1 * | 9/2012 | Kalavitz | F16B 21/04 29/825 |
| 2014/0265316 | A1 * | 9/2014 | Mullin | F16L 37/23 285/315 |
| 2016/0256752 | A1 * | 9/2016 | Wilkins | A63B 53/00 |

* cited by examiner

GOLF CLUB SYSTEM WITH INTERCHANGEABLE GOLF CLUB HEADS

This application is a continuation of U.S. patent application Ser. No. 14/814,438, filed Jul. 30, 2015 (pending), which claims the benefit of U.S. Provisional Application No. 62/031,145, filed, Jul. 30, 2014, and which is a continuation-in-part of U.S. patent application Ser. No. 14/142,739, filed Dec. 27, 2013 (pending), which claims the benefit of U.S. Provisional Application No. 61/747,180, filed Dec. 28, 2012, each of which is hereby incorporated by reference herein in its entirety.

BACKGROUND

Field of the Invention

The present invention relates generally to golf club and related equipment. More specifically, the present invention relates to a golf club system having interchangeable heads that each can fit onto a single shared shaft.

Background of the Invention

A common problem for golfers is transportation of a full set of golf clubs. Heavy and bulky sets of clubs are made heavier and bulkier by flight cases or travel bags. Due to costs associated with renting gold club sets at remote destinations, it is fairly common for golfer to bring their own clubs. Cost is not the only detractor to renting golf clubs at destination locations. Another factor is the quality of rental clubs often varies. In addition, golfers often develop a personal feel for, and comfort level with, their own golf clubs. Therefore, even a high quality rental or demo golf club sets may be unsuitable depending on a specific golfer's needs and/or desires. For example, experienced golfers may prefer to give themselves an advantage by using their own clubs.

A compact set of golf clubs may appeal to a wide and varied range of golfers. For example, those with cars may have inadequate trunk space for gold clubs. Some common sports cars, such as, for example the Corvette, have trunks that will not accommodate even one full-sized set of golf clubs. As used herein, a full-sized set of golf clubs refers to a set of golf clubs whereby each club comprises a club head fixedly attached to its own full-sized shaft. Many smaller vehicle trunks also have trouble accommodating more than a single set. Those with homes may have inadequate storage space for golf clubs. Cars are not the only place where sets of full size golf clubs can be difficult to manage. Golfers with homes may have inadequate storage space for golf clubs. Thus, there are many uses for sets of golf clubs that can be conveniently stored and transported.

Full-sized golf club sets are also heavy. As a result, more senior players may have trouble lifting and/or carrying a full-sized set of golf clubs. Full-sized sets of golf clubs may also be bulky, noisy when moved, and awkward to move, among other negative characteristics. When such full-sized golf club sets are placed in a hard-shell flight case the situation is generally exacerbated. Due to the weight of a flight case, flight cases can double the weight of a full-size set of clubs. Flight cases also add considerable bulk. Soft-shell flight cases are generally lighter and less bulky than hard-shell cases. However, soft-shell flight cases do not protect the clubs from the rigors of travel and expose the clubs to the vagaries of baggage handlers.

Thus, what is needed is a way to reduce the bulk and weight of a golf club set while preserving the playing physics and other desirable characteristics of the clubs.

BRIEF SUMMARY OF THE INVENTION

Embodiments of the present invention are directed to golf club sets that preserve playing physics while at the same time reduce the weight, bulk, and other undesirable characteristics of a full-sized set of golf clubs. As a result, embodiments allow golfers to enjoy these and other attendant advantages in a compact, easy to use set of golf clubs. Beyond the benefit of increased portability, it is also possible to choose among several shafts for any one club head. The ability to select different shafts for a particular club head expand the game of golf to include a new dimension of performance tuning because shafts vary considerably in stiffness or spring. Thus, embodiments of the present invention can allow all club heads to be matched to the best shaft for the playing situation at hand.

A number of design alternatives were explored before arriving at the current club and head system. One area of particular concern and experimentation is the coupler for connecting the shaft to the head. Several prototypes were built in an attempt to create a coupler that would satisfy the performance requirements of the high end golfer. While many requirements exist, one overarching requirement is tightness of fit. That is, the club heads and their male coupling pins needed to be held in contact with the coupler in the shaft without discernable wobble.

One design utilized two floating wedges that could slide out of the way for insertion of the coupling pin and back into position to wedge the pin in place. The wedge design relied on a long cylindrical opening in the coupler and a straight cylindrical coupling pin. The fit of the device depended, in part, on the tolerance of the machining of these two components. Machining long cylindrical sections has inherent difficulties. Machine tools for cutting these components tend to dull as the cut is achieved. Such dulling can be particularly problematic when many cuts are required such as, for example, in mass producing sets. Tool wear can be an issue for both drilled or lathed parts or any other machined parts involving a cutting tool that may wear over time. In the end, tolerances must be selected that are realistic for production. Even in prototype production quantities, parts machined to a tolerance of ±0.001 inches resulted in discernable "play" in the club with this design.

Another difficulty of this early design was the need for strong springs to force the wedges in place. While strong springs helped the wedges snap into place, the strong springs made the sleeve hard to pull back with thumb and finger. The wedges also were created by multiple machining cuts which made them more expensive than desired.

The final design involved ball bearings set in a coupler body and squeezed between tracks in the coupler body and tracks in a coupler pull-back sleeve. Released tension and lateral motion of the pull-back sleeve can allow the coupling pin to be inserted. Once inserted, the release of tension on the pull-back sleeve brings force to bear on flat surfaces of the coupler pin. Finally, this force pulls a conical surface on the coupler pin into contact with a mated conical sheath surface in the coupler. These two conical surfaces can be manufactured relatively easily and inexpensively and do not suffer from the many of the machining tolerance issues of the straight cylinder design.

A potential issue with the final design is loss of friction and fit from vibration during ball and head impact. Despite a tight fit, the spring and ball/race combination may be subject to release during high vibration. A twist lock would be desirable to minimize unintentional separation. There are also a number of alternate methods of locking the coupler.

The method described herein is preferred, but other locking methods would be known to those skilled in the art based upon the present disclosure.

Finally, the components of a compact golf system according to embodiments are stored in a unique bag. The small size and shape of this bag are a direct result of the design of the club system and provides an advantage to users in itself. This unique club head system makes many new bag designs possible.

According to one exemplary aspect, an embodiment of the present invention includes a coupler for mating a golf shaft handle to a club head comprising a first pin adapted to fit into a handle end of a golf shaft, a second pin adapted to fit into a club head end of a golf shaft, and a coupling sleeve fixedly attached to one of the first pin and the second pin, the coupling sleeve further being reversibly attachable to the other of the first pin and the second pin to allow for mating of the golf shaft handle to the club head when the coupler is in use on a golf club.

According to another exemplary aspect, an embodiment of the present invention includes A golf club having a detachable head comprising a first shaft segment and a second shaft segment, the first shaft segment having a grip or handle attached thereto and the second shaft segment being fixedly attached to a golf club head, and a coupler affixed to either the first shaft segment or the second shaft segment for reversibly mating the handle to the club head.

According to a further aspect, the coupler according to an embodiment comprises an inner housing and a pull-back sleeve, whereby the pull-back is sleeve movable with respect to the inner housing to allow for movement of one or more first ball bearings within the coupler such that in a first pull-back sleeve position, the ball bearings allow insertion of an insertion pin during mating of the first and second shaft segments, and in a second pull-back sleeve position, the ball bearings hold the insertion pin axially in place to reversibly secure the first shaft segment to the second shaft segment.

In another embodiment, a golf club according to an embodiment comprises a grip end having a shaft; and a coupler coupled to the shaft. The coupler comprises a grip end fitting coupled to the shaft, the grip end fitting having a hole into which a post is inserted and a notch; and a pullback sleeve with two ends, the pullback sleeve having a ramp on one end going around the circumference of the pullback sleeve, the ramp extending to a wall, wherein when the pullback sleeve is twisted in one direction, the post rides up the ramp until it becomes too difficult for twisting to continue, and when the pullback sleeve is twisted in the other direction, the post rides down the ramp until it is stopped by the wall such that it is aligned with the notch.

In another exemplary embodiment, a golf club comprises a grip end having a shaft, a golf club head that is coupled to the shaft, a coupler attached to the shaft to couple the golf club head to the shaft, wherein the coupler comprises a grip end fitting coupled to the shaft, the grip end fitting having a hole, a post (or pin) inserted into the hole in the grip end fitting, and a pullback sleeve with two ends and a slot, the pullback sleeve having a ramp on one end extending a portion of the way around the circumference of the pullback sleeve to a wall, wherein when the pullback sleeve is twisted in one direction, the post rides up the ramp until it becomes too difficult for twisting to continue, and when the pullback sleeve is twisted in the other direction, the post rides down the ramp until it is stopped by the wall such that it is aligned with the slot.

DETAILED DESCRIPTION

Figure 1:
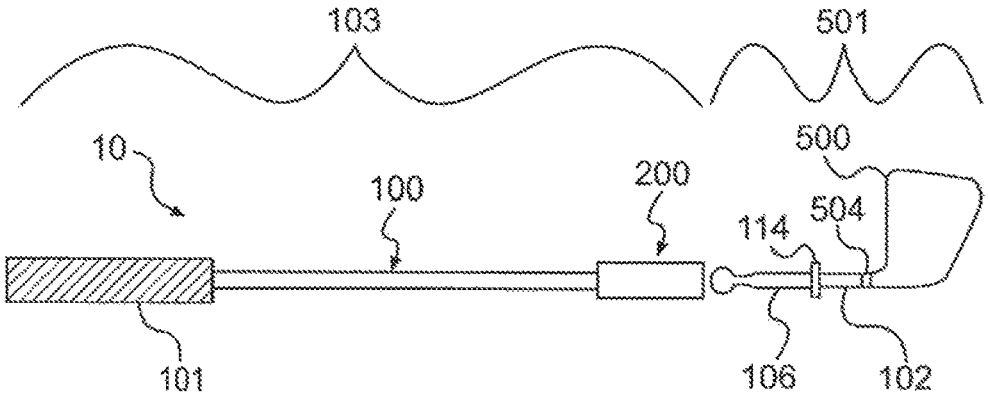
FIG. 1 shows a shaft with grip and head fitted with the coupler components ready to be connected.

FIG. 1 illustrates an exemplary golf club 10 according to an embodiment. Golf club 10 includes a large shaft segment 100 with a detachable head 500. Shaft 100 is cut from a standard full-sized shaft to accommodate the shortest club length—usually the putter. Alternatively, shaft segment 100 may be originally manufactured to the desired length, rather than cut from a longer shaft length. Club head 500, intended for mating with shaft segment 100, includes a shorter shaft section 102 between a club shaft insert sheath 504 and a head shaft segment coupler pin 106 (see FIG. 3).

The length of shaft section 100 is fixed, while the length of shaft section 102 can vary from club to club and may be used to set the club length optimally for that club. For example, longer clubs such as woods or long irons usually have longer overall shafts than short irons, wedges, and or putters (although some golfers prefer putters having long shaft length). By fixing the length of shaft segment 100, shaft section 102 can be varied to allow for varying shaft lengths desired for the various clubs in a golfers bag. Large shaft segment 100 is fitted to a coupler mechanism 200 via an insert pin 108 (see FIG. 3). Insert pin 108 is pressed and glued into the shaft, but may be affixed by any suitable manner known in the art.

The diameter of pin 108 is selected optimally to fit the inner diameter of shaft 100 at the shaft length used for the average person, but may also be custom fit to various players' specifications. Modern club shafts are often tapered such that their inner diameter varies along the length of the shaft. Club lengths for players usually vary less than six inches and are typically based on arm length and height of the player, but shaft lengths may be suited to any player's specifications. Because the difference in diameter for a shaft over a six inch section typically is not significant, the diameter of insert pin 108 is set to fit the smallest diameter of shaft 100 in an embodiment of the present invention. This corresponds, for example, to the longest club for the tallest player.

Pin 108 includes a threaded end 108*a* to accept fixed coupler housing 250. This thread is preferably counter-clockwise for right handed players and clockwise for left handed players. The desire for different threading direction based on handedness is due, in part, to the opposing torque/twists generated by left- and right-handed golfers about the shaft. Coupler housing 250 has internal threads to appropriately match the threaded end 108*a* of pin 108. Coupler housing 250 may also be affixed to shaft 100 in other ways known in the art, for example, using epoxy.

Figure 3:
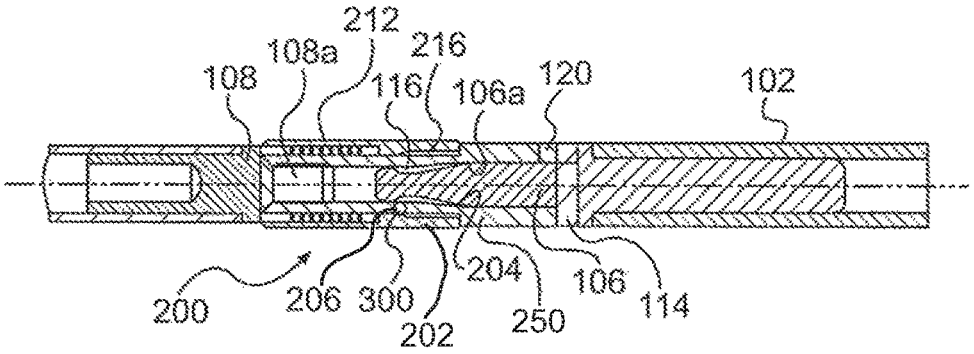
FIG. 3 is a cross sectional view through line 3-3 of the coupler of FIG. 2.

As seen in FIG. 3, coupler housing 250 has several features. It has a conical portion 204 to mate with matching conical surface 106*a* of the coupler pin 106 affixed to club head 500. It has multiple ball bearing guide holes 206 to hold ball bearings 300 in place. As seen in FIG. 3, only one such guide hole 206 is shown in the cross section, but others may be located about the perimeter. In a preferred embodiment, there are three equally spaced guide holes 206 located about a perimeter of coupler housing 250.

Figure 2:
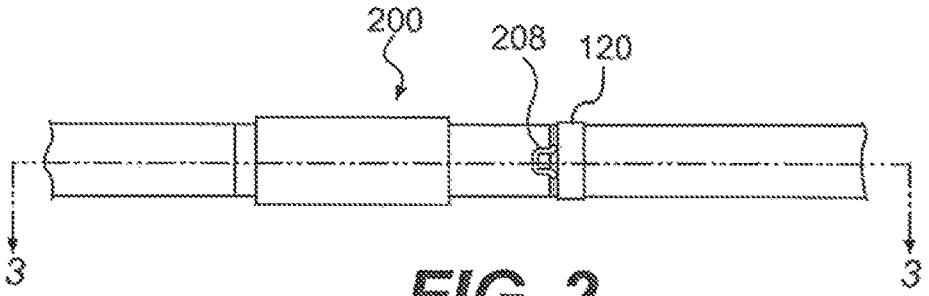
FIG. 2 shows the pull-back sleeve according to an exemplary embodiment of the present invention in isolation.
Figure 4:
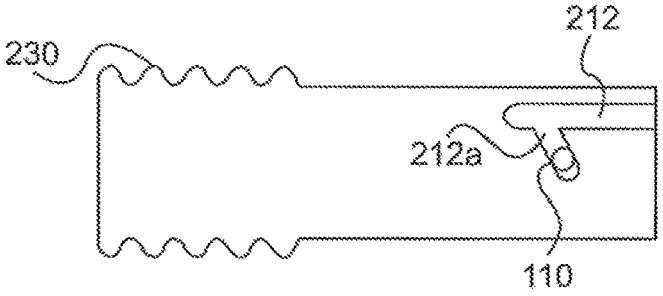
FIG. 4 is a cross-sectional schematic view of a coupler according to an exemplary embodiment of the present invention showing a locking mechanism to limit rotational motion of the club head with respect to the shaft when the head is assembled to the shaft.

As seen in FIGS. 2 and 4, there is a notch 208 to provide a clocking fit to alignment pin 120 in the coupler pin 106. Pin 120 and notch 208 assure the shaft handle always lines up the same way with all club heads. Another pin 110 is press fit into the side of coupler housing 200 to provide clocking into the "L" shaped guide of the pull back sleeve 202.

Head coupling pin 106 is inserted and glued, or otherwise affixed, into the head shaft segments 102 as previously described. These shaft segments 102 vary in length significantly and thus the inside diameter of these shaft segments varies significantly also. In this case, the variation is enough to affect the need for head coupling pins 106 of various diameters. This may or may not be a need in other embodiments since manufacturers may make all parts for a design and simply standardize on an inner diameter of this part. The design described here relies on modification of readily available club components which have variations.

Figure 5A:
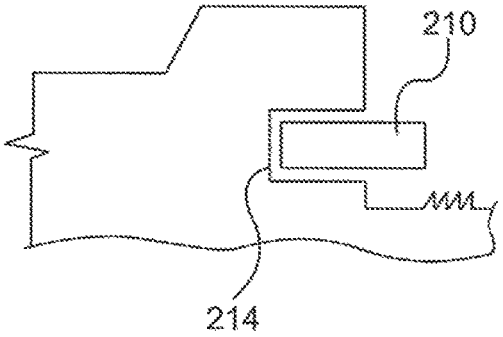
FIGS. 5A-5C show three views of the shaft coupler insert with pressed in spring pin retainer for the locking mechanism according to a preferred embodiment of the present invention.
Figure 5B:
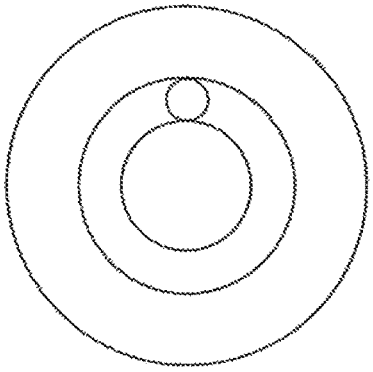
Figure 5C:
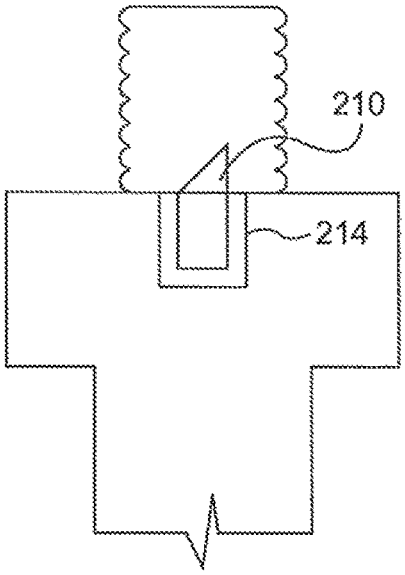
Figure 6:
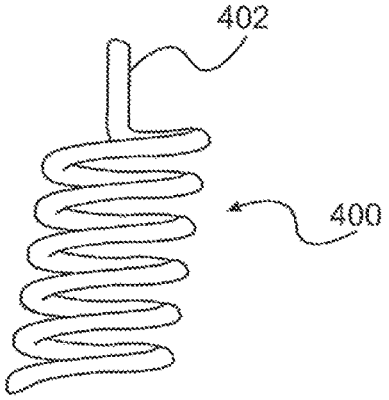
FIG. 6 shows a spring for use inside the coupler.

Housing 200 also includes a press-fit pin 210 to hold a twist to a spring 400 (see FIG. 6). As shown in FIGS. 5A-5C, pin 210 and hole 214 work together to hold spring 400 in a position of tension to provide a twisting force for the operation of the locking mechanism. Pin 210 wedges the base of the spring 400 and hole 214 receives a short vertical section 402 at the end of spring 400. Spring 400 is twisted to latch during assembly. The twist maintains coupler 200 in locked position at all times. The pull back sleeve 202 must be twisted and pulled back by the golfer in order to pull out the head. When the coupler pin is extracted, pin 110 slides into retaining area 212*a* to hold it in place until another coupler pin 106 for another head is inserted. This simplifies the hand motions necessary to insert and extract a club while allowing an automatic locking of the coupler.

The head coupling pin 106 has a pressed in pin 120 for locking fit as previously described. Although other kinds of pins can be used, the use of a press fit pin here, and other places in the invention, is preferred as it reduces cost and complexity of manufacture.

Coupler 200 also includes a pullback sleeve 202. In an embodiment, pullback sleeve 202 has a knurled surface 230 which facilitates gripping for hand operation. Although this is shown as a knurled surface, it may be of any surface texture, including being smooth, so long as the sleeve is movable by a user gripping coupler 200 by hand. The sleeve 202 must be pulled and rotated at various times during operation. Sleeve 202 has several surfaces which help make the coupler hold without "play". The conical, or rounded, surface of the end of coupler pin 106 is slowly sloping to allow easy insertion. This rounded end surface presses on the ball bearings 300 during insertion. The ball bearings 300 alternately push on the surface 216 of the pull back sleeve 202. The force of insertion is translated by the angles and rotation of the ball bearings into a motion of the pull back sleeve 202 against spring 400.

During insertion, the operator pulls sleeve 202 toward the shaft using thumb and index finger. This positions the ball bearings 300 free from surface 216 so they can allow passage of the nose of pin 106. When the ball bearings 300 pass over the crest of the nose surface on pin 106 they "fall" into contact with surface 116. When this occurs sleeve 202 can be released coming to rest close to the coupler pin hilt ring 114. In this position the clocking pin 120 is at rest in the notch 208 and the ball bearing 300 is in contact with surfaces 116 and 216.

As sleeve 202 moves in the direction away from club head 500, locking pin 110 becomes clear of notch 212. As this occurs, the twisting force of spring 400 causes sleeve 202 to rotate until pin 110 slides into channel 212*a*. As pin 106 presses further into the coupler 200, sleeve 202 continues to move further away from club head 500. This can be seen as an increasing gap between sleeve 202 and the "hilt" region 114 of coupler pin 106. When the ball bearings 300 pass over the crest of the surface 116 they "fall" into contact with surface 216. As this occurs, sleeve 202 changes direction and comes to rest close to the coupler pin hilt ring 114. In this position, the locking pin 120 is at rest in the notch 208 and the ball bearing 300 is in contact with surfaces 116 and 216.

The angle of surface 116 is steep enough to make a force large enough to enable the ball bearing 300 to "climb" up and thus uncouple. Under static conditions, the force necessary to make this uncoupling occur are well beyond those found in golf club operation. The angle of surface 216 should not be so steep, however, that it cannot be uncoupled by hand when the pull-back sleeve 202 is manipulated by the user. For example, in one embodiment of the present invention angle of surface 216 is approximately 12 degrees.

There is, however, a possibility of vibration assisting this "climb". To account for this possibility, the locking mechanism described above can be employed. However, the locking mechanism is not necessary for the operation or manufacture of a golf club with interchangeable heads according to embodiments of the present invention.

Moreover, other locking mechanisms, for example, the use of a ball bearing for locking pin 110 can be used in embodiments of the present invention to assure adequate locking during operation. The mechanism described here was selected to simplify the manual operation of the coupler.

Figure 7:
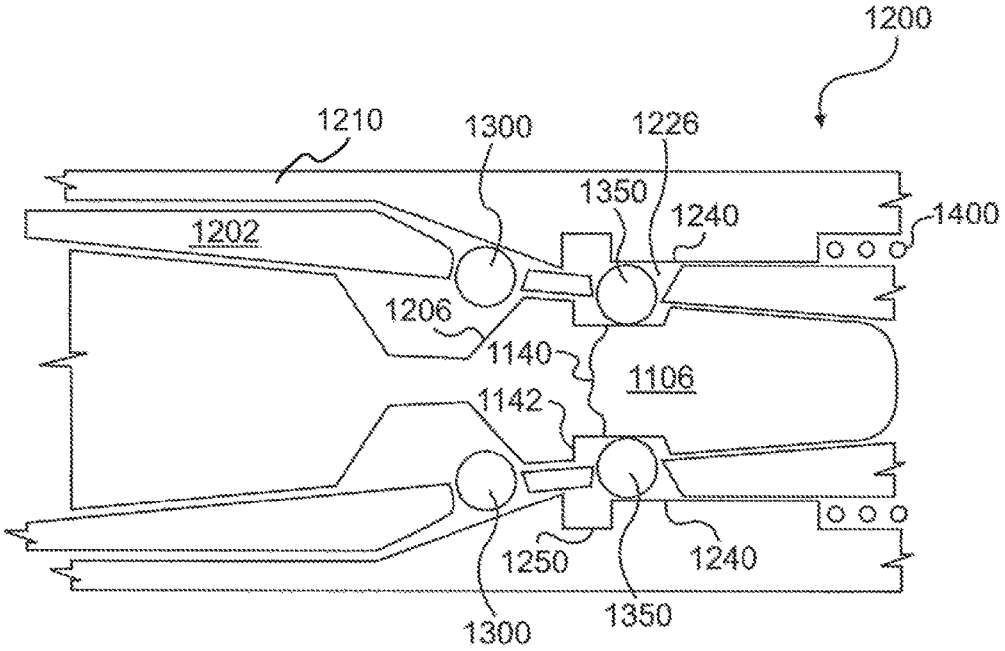
FIG. 7 shows another exemplary embodiment of a coupler having a second set of ball bearing for locking the couple and pin during operation.

FIG. 7 shows coupler 1200 with pin 1106 inserted and held in place by ball bearings 1300 and locked by bearings 1350. Bearings 1350 are held in coupler component 1202 by holes 1226. There are three bearings 1350 oriented 120 degrees apart (similar bearings 1300). When these bearings are between surfaces 1140 of pin 1106 and surfaces 1240 of the pull back sleeve 1210, the coupler 1200 will be locked and can only be released by manual operation. To visualize this, one can imagine ball bearings 1300 climbing surface 1206 and thus causing pull back sleeve 1210 to move towards the shaft 100 (not shown in FIG. 7). This would allow pin 1106 to begin to uncouple. Ball bearings 1350 will then wedge against surface 1142, which is perpendicular to this direction of motion. The combination of surfaces 1140, 1142, and 1240 form a sort of box, which is filled by ball bearing 1350, thus preventing uncoupling.

Manual uncoupling is possible because the operator moves the pull back sleeve 1202 against spring 1400, positioning surface 1250 at ball bearing 1350. In this position, the ball bearings 1350 can move out of the way of the coupling pin 1106 and extraction can occur. Insertion is done in an analogous, but reverse manner.

While the foregoing embodiments are acceptable in the vast majority of cases, the above-described issues with machine tolerances can result in slight movements between components of the coupler. FIGS. 8A-8D, 9A-9J, 10A-10F, and 11A-11B are schematic diagrams illustrating a coupler that addresses such movements by modifying a grip end fitting and pullback sleeve of the coupler.

Figure 8B:
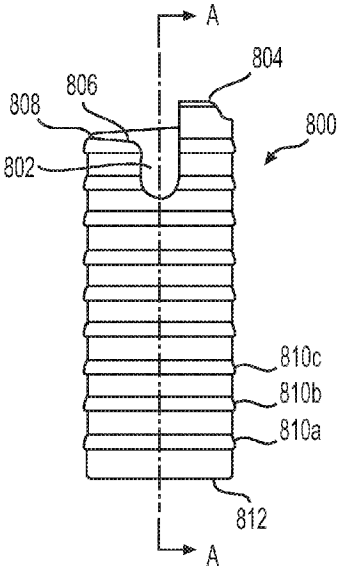
FIGS. 8A-8D are schematic illustrations of a pullback sleeve 800 according to an embodiment.
Figure 8D:
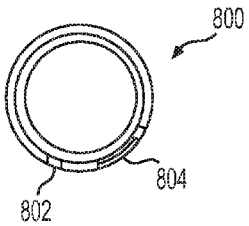
Figure 8C:
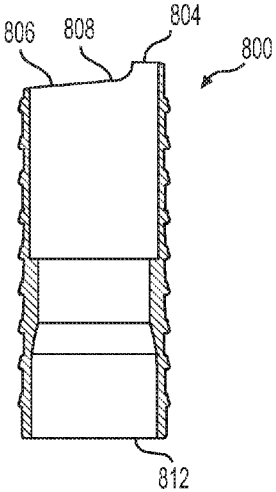
Figure 8A:
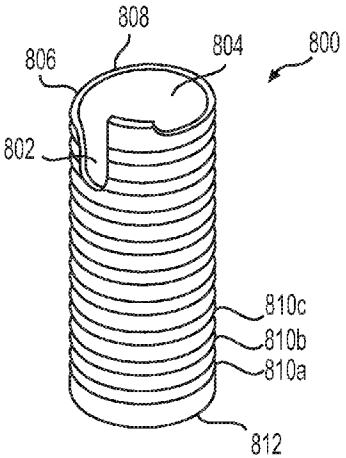

FIGS. 8A-8D are schematic illustrations of a pullback sleeve 800 according to an embodiment. FIG. 8C is a cross-sectional view of pullback sleeve 800 taken at line A-A in FIG. 8B. FIG. 8D is a view looking down into pullback sleeve 800. In an embodiment, pullback sleeve 800 having a top end 808 and a bottom end 812. In an embodiment, top end 808 is closer to the handle end of the golf club than bottom end 812. Pullback sleeve 800 includes a notch or slot 802, a wall 804, and a ramp 806. In an embodiment, ramp 806 extends around a top end 808 of pullback sleeve 800 and ends at wall 804. As illustrated in FIGS. 8A and 8B, ridges 810*a*, 810*b*, 810*c*, etc. are present in an outer surface of pullback sleeve 800. Any desired number of ridges can be used in an embodiment.

Figures 9A, 9B, 9C, 9D, 9E, 9F, 9G, 9H, 9I, 9J:
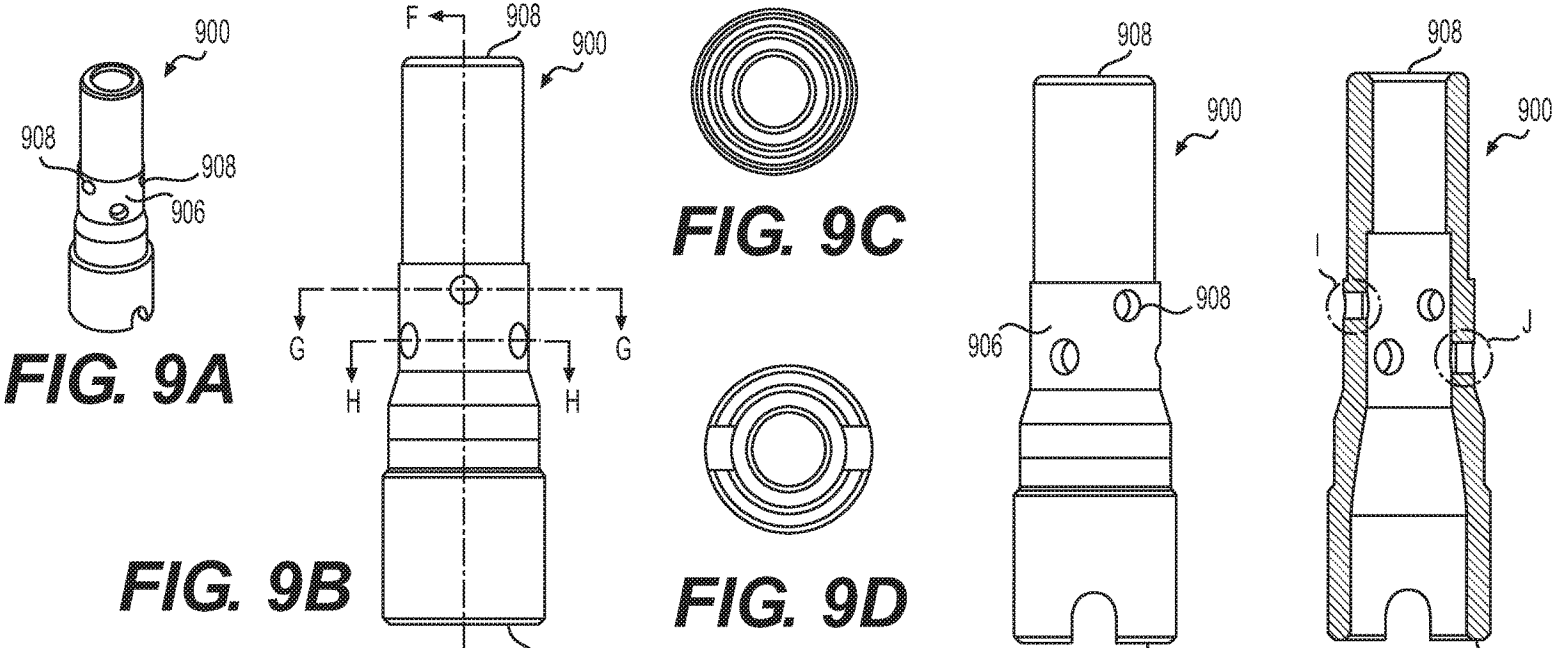
FIGS. 9A-9J are schematic illustrations of a coupler body according to an embodiment.

FIGS. 9A-9J are schematic illustrations of a coupler body 900 according to an embodiment. FIG. 9C is a view looking down into coupler body 900. FIG. 9D is a view looking up into the coupler body 900. FIG. 9F is a cross-sectional view of coupler body 900 taken at line F-F in FIG. 9B. FIG. 9G is a cross-sectional view of coupler body 900 taken at line G-G in FIG. 9B. FIG. 9H is a cross-sectional view of coupler body 900 taken at line H-H in FIG. 9B. FIG. 9I is expanded detail of "I" in FIG. 9F. FIG. 9J is expanded detail of "J" in FIG. 9F. A first set of ball bearings 904*a*, 904*b*, and 904*c* is seated in holes 906. A second set of ball bearings 902*a*, 902*b*, and 902*c* is seated in holes 908. For example, in an embodiment, ball bearing 902*a*, 902*b*, and 902*c* correspond to ball bearings 1350 in FIG. 7, and ball bearing 904*a*, 904*b*, and 904*c* correspond to ball bearings 1300 in FIG. 7. In an embodiment, coupler body 900 corresponds to coupler body 1202 in FIG. 7.

Figure 10C:
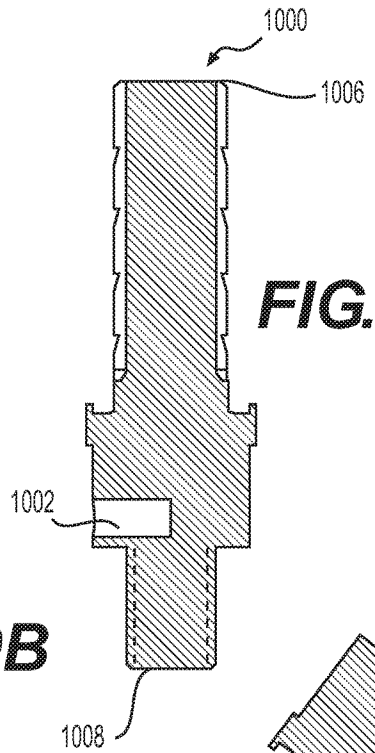
FIGS. 10A-10F are schematic illustrations of a grip end fitting according to an embodiment.
Figure 10F:
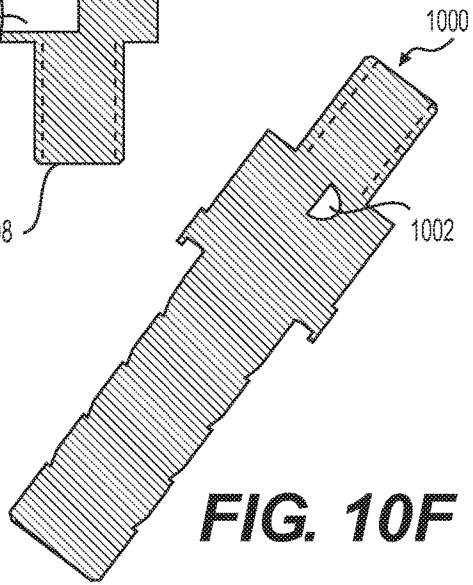
Figure 10B:
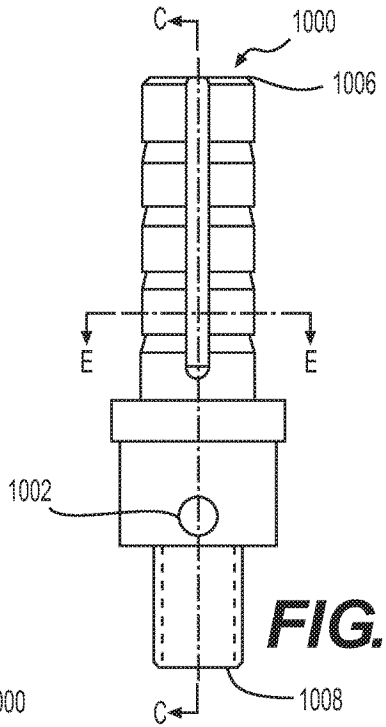
Figure 10E:
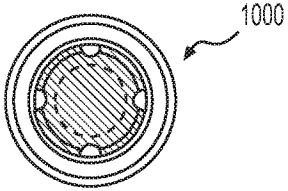
Figure 10A:
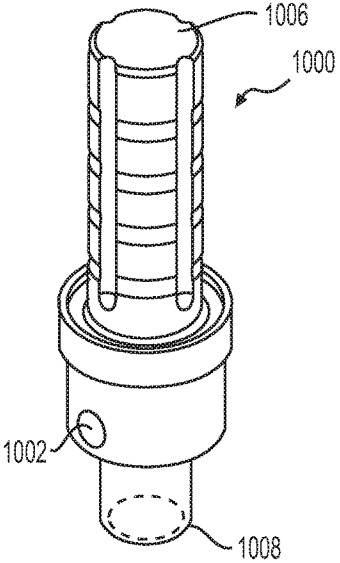
Figure 10D:
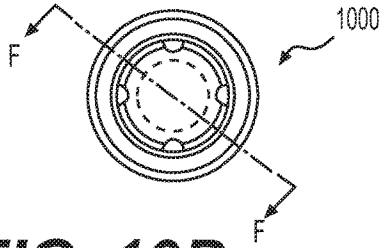

FIGS. 10A-10F are schematic illustrations of a grip end fitting 1000 according to an embodiment. Grip end fitting 1000 fits into the grip end or shaft 100 as a base for the coupler housing, such as the coupler of FIG. 7. Grip end fitting 1000 includes a hole 1002. A post or pin 1004 (see FIGS. 11A and 11B) is inserted into hole 1002. In an embodiment, such insertion is by press fitting pin or post 1004 into hole 1002. FIG. 10C is a cross-sectional view of grip end fitting 1000 taken at line C-C in FIG. 10B. FIG. 10D is a view looking down into grip end fitting 1000. FIG. 10E is a cross-sectional view of grip end fitting 1000 taken at line E-E in FIG. 10B. FIG. 10F is a cross-sectional view of grip end fitting 1000 taken at line F-F in FIG. 10D. As shown in FIGS. 10A, 10B, and 10C, grip end fitting has a top end 1006 and a bottom end 1008. In an embodiment, top end 1006 is positioned closer to the handle of a golf club.

Figure 11A:
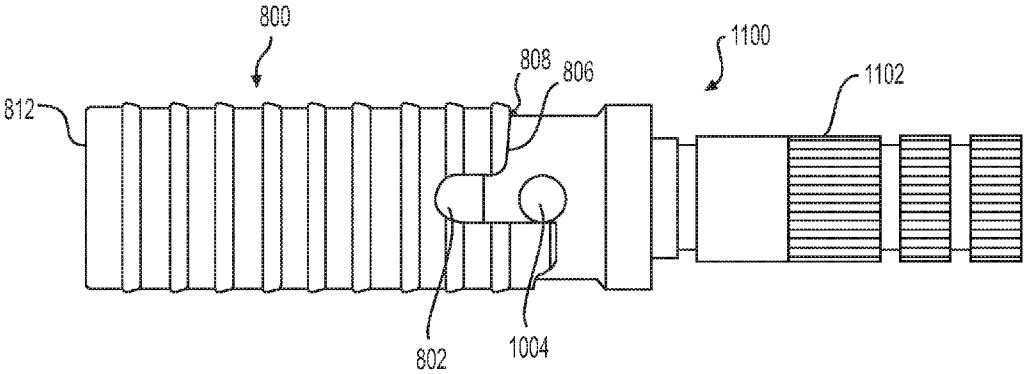
FIG. 11A illustrates a coupler assembly in a loose condition according to an embodiment.
Figure 11B:
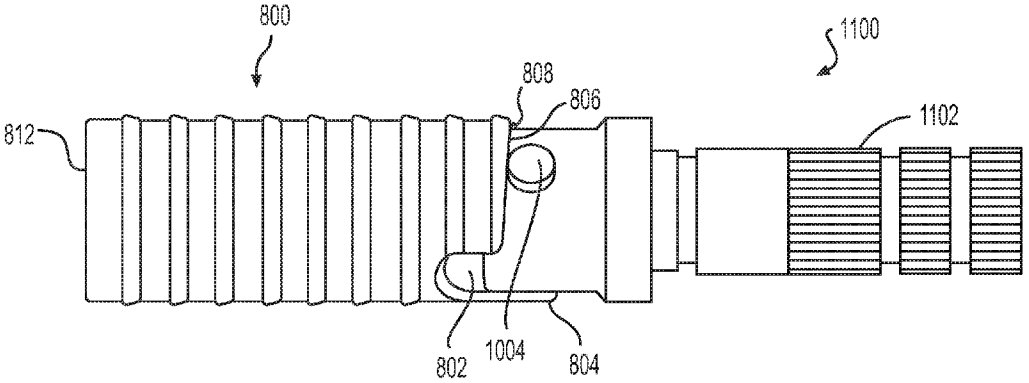
FIG. 11B illustrates a coupler assembly in a tightly coupled condition according to an embodiment.

FIG. 11A illustrates a coupler assembly 1100 in the loose condition according to an embodiment. In the loose condition, slot 802 allows for the pullback sleeve to be pulled back to insert an interchangeable club head. FIG. 11B illustrates a coupler assembly 1100 in a tightly coupled condition according to an embodiment. In an embodiment, section 1102 of coupler assembly 1100 is inserted in a lower shaft segment 1902 of the golf club described in FIG. 12. In an embodiment, coupler assembly 1100 is coupler 200 as described above with respect to FIG. 3 or coupler 1200 as described above with respect to FIG. 7.

No interchangeable club head is shown in FIGS. 11A or 11B. However, in operation, pullback sleeve 800 is pulled back (toward the right in FIG. 11A), post or pin 1004 moves into notch 802, and an interchangeable club head is inserted as described above. Once inserted, the user releases pullback sleeve 800, which moves pin 1004 out of slot 802. To more tightly couple the coupler components, that is to transition from the configuration in FIG. 11A to FIG. 11B, the user twists pullback sleeve 800 (counterclockwise in the illustration of FIGS. 11A and 11B), which causes pin or post 1004 to ride up ramp 806. Eventually, the user will no longer be able to twist pullback sleeve 800 the due to the slope of the ramp and the coupler components being very tightly coupled.

To uncouple a club head, the user twists pullback sleeve 800 (in the clockwise direction as shown in FIGS. 11A and 11B) such that the post travels down ramp 806. Wall 804 stops the travel of post 1004 such that post 1004 is aligned with slot 802. At this point, the user can pull back pullback sleeve 800 with post or pin 1004 moving into slot 802, and removes the club head.

The ramp angle of ramp 806 must be steep enough such that pin or post 1004 will ultimately make twisting pullback sleeve 800 difficult, that is, essentially stopping twisting, but not so steep that twisting pullback sleeve 800 is initially difficult. The ramp also should also prevent twisting prior to the twisting going all the way round to notch 802. For example, a ramp angle can be chosen that will cause twisting of the pull back sleeve to become too difficult within 270 degrees of rotation. A ramp angle of 6 degrees has been found to be acceptable, and generally results in twisting becoming too difficult within a fairly short distance. Ramp angles may be different for different club head due to the length of shaft segment 102.

Figure 12:
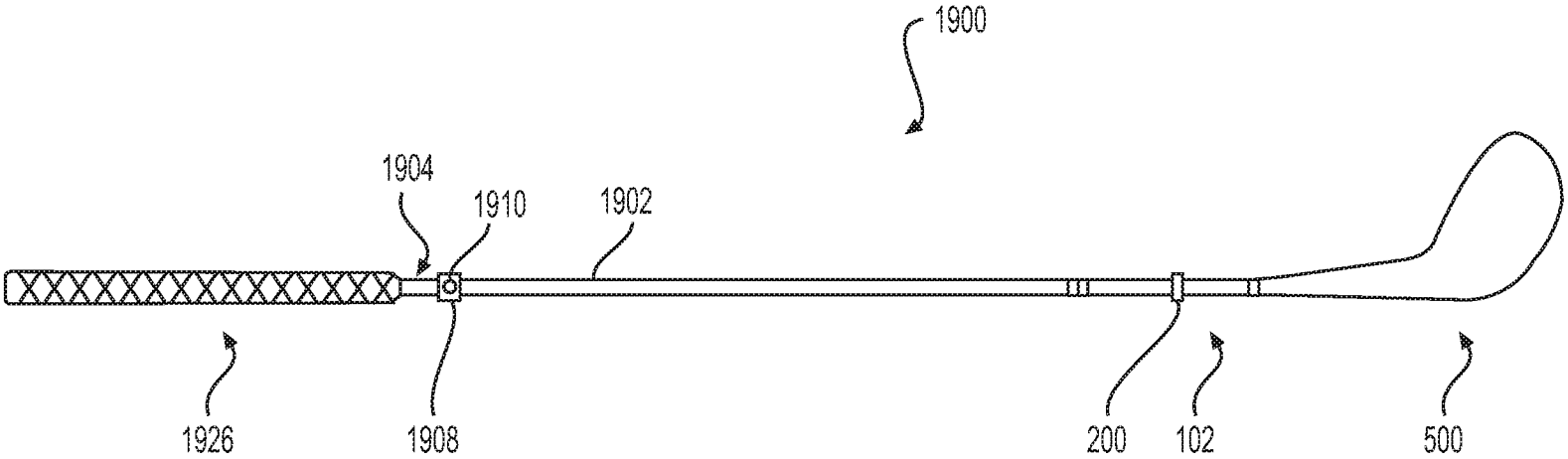
FIG. 12 illustrates a fully assembled golf club using two couplers according to an embodiment.
Figure 13:
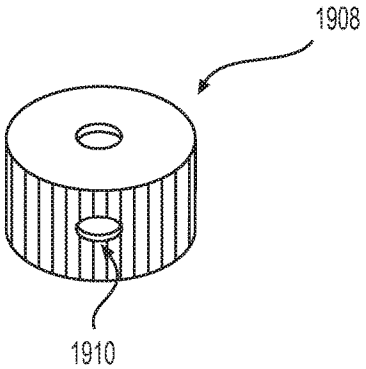
FIG. 13 illustrates a collar that can be used with a coupler that couples an upper shaft segment to a lower shaft segment.

FIG. 12 illustrates a fully assembled golf club 1900 using two couplers. A first coupler 200 (or coupler 1200) couples interchangeable golf club heads to a golf shaft such as described above, and a second coupler 1900 an upper shaft segment 1904 having a grip 1926 to a lower shaft segment 1902. Such a second coupler is described in U.S. patent application Ser. No. 14/142,739, filed Dec. 27, 2013, published Jul. 3, 2014 as U.S. Pub. No. 2014/0187342, entitled "Golf Club System with Golf Club Bag", to Brady, which is hereby incorporated by reference in its entirety. In embodiment, coupler 1900 has a collar 1908 that is used to tighten the coupler 1900 to tightly couple the upper shaft segment 1904 and to lower shaft segment 1902. In an embodiment, coupler 1900 is a screw-type coupler, and collar 1908 facilitates screwing one portion of coupler 1900 to the other. Such a collar 1908 is shown in FIG. 13. As shown in FIG. 13, collar 1908 has an aperture 1910.

Figure 14:
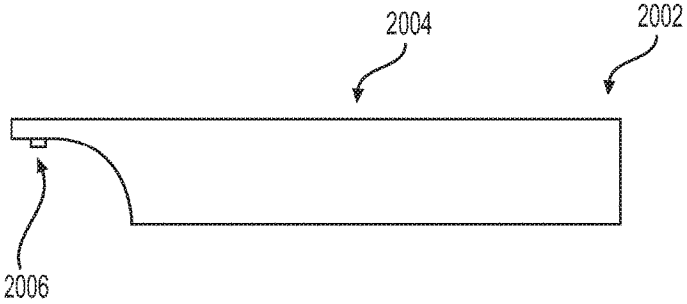
FIG. 14 illustrates a tool that can be used to assist in tightening a coupler using a collar as shown in FIG. 13.

Because some people may not have the strength to twist collar 1908 sufficiently to tightly couple the upper and lower shaft segments, a tightening tool can be employed to assist in tightening the coupler. An exemplary tightening tool 2002 is illustrated in FIG. 14. Tightening tool 2002 comprises a handle 2004 and a pin 2006. In operation, pin 2004 fits into an aperture 1910 in collar 1908 as shown in FIG. 13. Handle 2004 provides leverage to allow coupler collar 1908 to be held in place while the upper shaft segment 1904 or lower shaft segment 1902 is rotated to tightly couple the upper and lower shaft segments.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention

What is claimed is:

1. A golf club system, comprising:

an upper shaft segment having a golf club grip thereon and a first portion of a first coupler;

a lower shaft segment having a second portion of the first coupler to be mated with the first portion of the first coupler, the lower shaft segment further having a grip end fitting that forms a first portion of a second coupler, wherein the grip end fitting that forms the first portion of the second coupler includes a pullback sleeve with two ends and a post, the pullback sleeve having a ramp on one end extending a portion of the way around the circumference of the pullback sleeve; and a plurality of golf club heads, each golf club head having a club head fitting that forms a second portion of the second coupler to be mated with the grip end fitting;

wherein when the pullback sleeve is twisted in one direction, the post rides up the ramp until it becomes too difficult for twisting to continue such that the golf club head is securely fastened to the lower shaft segment.

2. The golf club system recited in claim 1, wherein the grip end fitting comprises:

a hole; wherein the post is placed in the hole and rides up the ramp until it becomes too difficult for twisting to continue when the pullback sleeve is twisted in the one direction; and the pullback sleeve further comprises:

a wall to which the ramp on the end of the pullback sleeve extends; and a slot that is aligned with the post when the pullback sleeve is twisted in the other direction such that the post rides down the ramp until it is stopped by the wall.

3. The golf club recited in claim 2, wherein the first coupler comprises a collar to assist in tightly coupling the upper and lower shaft segments.

4. The golf club system recited in claim 3, wherein the collar comprises an aperture that allows insertion of a pin of a tightening tool that allows tightening of a collar to hold the first coupler in place to allow tightening of the first coupler by twisting one of the upper and lower shaft segments.

5. The golf club system recited in claim 3, wherein each club head fitting has a head shaft segment coupler pin and the second coupler comprises a spring and a coupler body that has a first set of ball bearings that due to force exerted by the spring ride up an angled edge of the head shaft segment coupler pin to tightly couple the golf club head to the lower shaft segment.

6. The golf club system recited in claim 5, wherein the second coupler comprises a second set of ball bearings that prevent separation of the golf club head from the shaft.

7. The golf club system recited in claim 2, wherein the post is press fit into the hole.

8. The golf club system recited in claim 1, wherein the pullback sleeve comprises a plurality of ridges.

9. The golf club system recited in claim 1, wherein each club head fitting has a head shaft segment coupler pin and the second coupler comprises a spring and a coupler body that has a first set of ball bearings that due to force exerted by the spring ride up an angled edge of the head shaft segment coupler pin to tightly couple the golf club head to the shaft.

10. The golf club system recited in claim 9, wherein the second coupler comprises a second set of ball bearings that prevent separation of the golf club head from the shaft.

* * * * *